US006174096B1

(12) United States Patent
Harris

(10) Patent No.: US 6,174,096 B1
(45) Date of Patent: Jan. 16, 2001

(54) PRINTING APPARATUS

(75) Inventor: Richard Hunter Harris, Raleigh, NC (US)

(73) Assignee: International Business Machines Corporation, Armonk, NY (US)

( * ) Notice: Under 35 U.S.C. 154(b), the term of this patent shall be extended for 0 days.

(21) Appl. No.: 09/360,390

(22) Filed: Jul. 23, 1999

Related U.S. Application Data

(62) Division of application No. 09/005,266, filed on Jan. 9, 1998, now Pat. No. 5,993,095.

(51) Int. Cl.[7] ..... B41J 33/22
(52) U.S. Cl. ..... 400/236.2; 400/225
(58) Field of Search ..... 400/236.2, 236.1, 400/236, 225, 223, 187, 185, 636.2, 634

(56) References Cited

U.S. PATENT DOCUMENTS 4,376,585 * 3/1983 Fromme et al. ..... 400/225
4,651,165 * 3/1987 Shimada ..... 400/185
4,712,931 * 12/1987 Ohshima ..... 400/236.2
5,570,606 11/1996 Irie ..... 74/89.14
5,605,071 2/1997 Buchanan ..... 74/425
5,707,159 * 1/1998 Yamamoto et al. ..... 400/236.2
5,842,795 * 12/1998 Narita et al. ..... 400/185

FOREIGN PATENT DOCUMENTS 63-64785 * 3/1988 (JP) ..... 400/236.2

* cited by examiner

*Primary Examiner*—John S. Hilten
*Assistant Examiner*—Anthony H. Nguyen
(74) *Attorney, Agent, or Firm*—John D. Flynn; Winstead, Sechrest & Minick

(57) ABSTRACT

An apparatus to drive a ribbon carrying a printing medium in an impact printer is implemented. The apparatus accommodates manual tightening of the ribbon by decoupling the drive motor from the ribbon cartridge without use of a clutch mechanism. A gear train effecting the required speed reductions between a drive motor and the ribbon cartridge spool also implements the decoupling. Reliability of the ribbon drive is improved thereby, and manufacturing and assembly costs are reduced over ribbon drives now used in impact printers.

8 Claims, 6 Drawing Sheets

PRINTING APPARATUS

This application is a division of Ser. No. 09/005,266, filed Jan. 9, 1998, and now U.S. Pat. No. 5,993,095.

TECHNICAL FIELD

The present invention relates in general to impact printers, and in particular, to a drive mechanism for the ink ribbon cartridge in such printers.

BACKGROUND INFORMATION

Impact printers using an ink ribbon to carry the printing medium from which characters on the printed page are formed must employ a ribbon drive mechanism to advance the ink ribbon so that fresh portions of the ribbon are available for printing. The mechanism driving the ribbon must accommodate manual tightening of the ribbon.

FIG. 1 illustrates an impact printer, printer 100, in which the ink ribbon 104 is supplied in a ribbon cartridge, ribbon cartridge 101. Printer 100 also includes a ribbon drive, ribbon drive 102. Ribbon drive 102 may be a ribbon drive according to the prior art, or the ribbon drive of the present invention. A portion (see ribbon pinion 207 in FIG. 2) of ribbon drive 102 engages a spool (not shown) within ribbon cartridge 101 and advances the ink ribbon 104. In order to manually tighten the ribbon 104, ribbon cartridge 101 incorporates knob 103, illustrated in the inset. By manually turning knob 103 in the same direction as the cartridge is driven, the ribbon 104 may be manually tightened. An enlarged view of such a ribbon-tightening knob is shown in FIG. 6. Ribbon drive 102 must accommodate free rotation to permit manual tightening of the ribbon 104 while the ribbon cartridge is engaged with the ribbon drive 102. This is complicated by the large speed reduction that is effected between the speed of the driving means for driving ribbon drive 102, and the speed at which the ribbon 104 advances, which necessarily must be the rotation speed of an output of ribbon drive 102.

Refer now to FIG. 2, in which is depicted a ribbon drive, ribbon drive 200, in accordance with the prior art. Ribbon drive 200 includes ribbon motor 201 and gear mount bottom 202, which supports gear 203 (shown in normal and inverted views), gear 204 (shown in normal and inverted views), and pinion gear 205. These gears are enclosed by gear mount top 206. Ribbon pinion 207 (which engages the spool (not shown) in ribbon cartridge 101) passes through an opening 210 in gear mount top 206 and is coupled to pinion gear 205, through which it is driven. Gear 203, gear 204, and pinion gear 205 effect the speed reduction between the speed of ribbon motor 201 and the speed of ribbon pinion 207 which drives the ribbon 104. Because the speed at which the ribbon 104 advances is substantially slower than the rotational speed of ribbon motor 201, the speed reduction produced through gear 203, gear 204, and pinion gear 205 is also substantial. Consequently, the torque that would need to be applied to knob 103 in order to manually tighten the ribbon 104 would be considerable unless a means were incorporated to decouple ribbon pinion 207 from pinion gear 205. This is achieved in the prior art by the use of spring clutch 208. When ribbon pinion 207 is rotated manually through its engagement with knob 103, spring clutch 208 decouples ribbon pinion 207 and pinion gear 205, and thereby the rest of the ribbon drive 200. In this way, knob 103 and ribbon pinion 207 may be freely rotated, and the ribbon 104 manually tightened, without rotating the remaining portions of ribbon drive 200.

Achieving the required speed reductions through the use of a gear train employing multiple individual gears, and a spring clutch to decouple the gear train from the ribbon pinion increases manufacturing and assembly costs and decreases reliability. Thus, there is a need in the art for an improved ribbon drive that incorporates fewer parts, thereby reducing manufacturing and assembly costs, and improving reliability.

SUMMARY OF THE INVENTION

The present invention addresses the previously mentioned needs by providing an improved ribbon drive that requires only four parts to achieve the requisite speed reductions as well as accommodating manual tightening of the ribbon. A worm gear which is rotated by a drive means further rotates a compound worm gear. The compound worm gear includes a pair of gear structures on a common shaft. One is a pinion gear that engages the worm gear, and the second is a worm which is rotated as the common shaft is rotated by the action of the worm gear on the pinion gear. The worm on the compound worm gear further engages a pinion gear on a pinion. The pinion then drives the ribbon cartridge. The compound worm gear is supported within a worm gear frame, through which the worm gear passes via an opening in the worm gear frame, in order to engage the pinion gear on the compound worm gear.

Manual ribbon tightening is accommodated through pivotal motion of the worm gear frame. The worm gear frame is free to pivot about the worm gear. When the worm gear is being rotated by the drive means, the engagement of the worm gear with the pinion gear on the compound worm gear tends to cause the compound worm gear also to rotate. Moreover, the force of the worm gear on the teeth of the pinion gear produces a moment which tends to cause the compound worm gear and the worm gear frame in which it is supported to pivot about the worm gear. This tendency to pivot on the part of the compound worm gear and the worm gear frame is restrained by the pinion. The worm on the compound worm gear engages the pinion gear on the pinion and the tendency of the compound worm gear to pivot acts to force the worm against the teeth of the pinion gear on the pinion.

The rotation of the compound worm gear, and hence the worm on the compound worm gear, then rotates the pinion. Rotation of the pinion then advances the printer ribbon. When the drive means is off, rotation of the pinion during manual tightening of the ribbon leads to a decoupling of the gear train in an analogous fashion, as will now be described.

With the drive means off, rotation of the pinion, and thereby the pinion gear attached thereto, forces the teeth of the pinion gear into the worm of the compound worm gear. This produces a moment about the worm gear. This moment in turn causes the compound worm gear to tend to pivot about that gear. The compound worm gear is supported in the worm gear frame, and thus, the worm gear frame also tends to pivot under the action of this moment. Because there is nothing to restrain this pivoting, the compound worm gear and the worm gear frame pivot away from the pinion. They will continue to pivot, at least, until the teeth on the pinion gear of the pinion no longer engage the worm on the compound worm gear. This effects the decoupling of the gear train that is necessary to accommodate the manual tightening of the tape. When the drive means subsequently is energized, the pivoting action previously described causes the worm on the compound worm gear to reengage the pinion gear on the pinion thereby rotating the ribbon.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
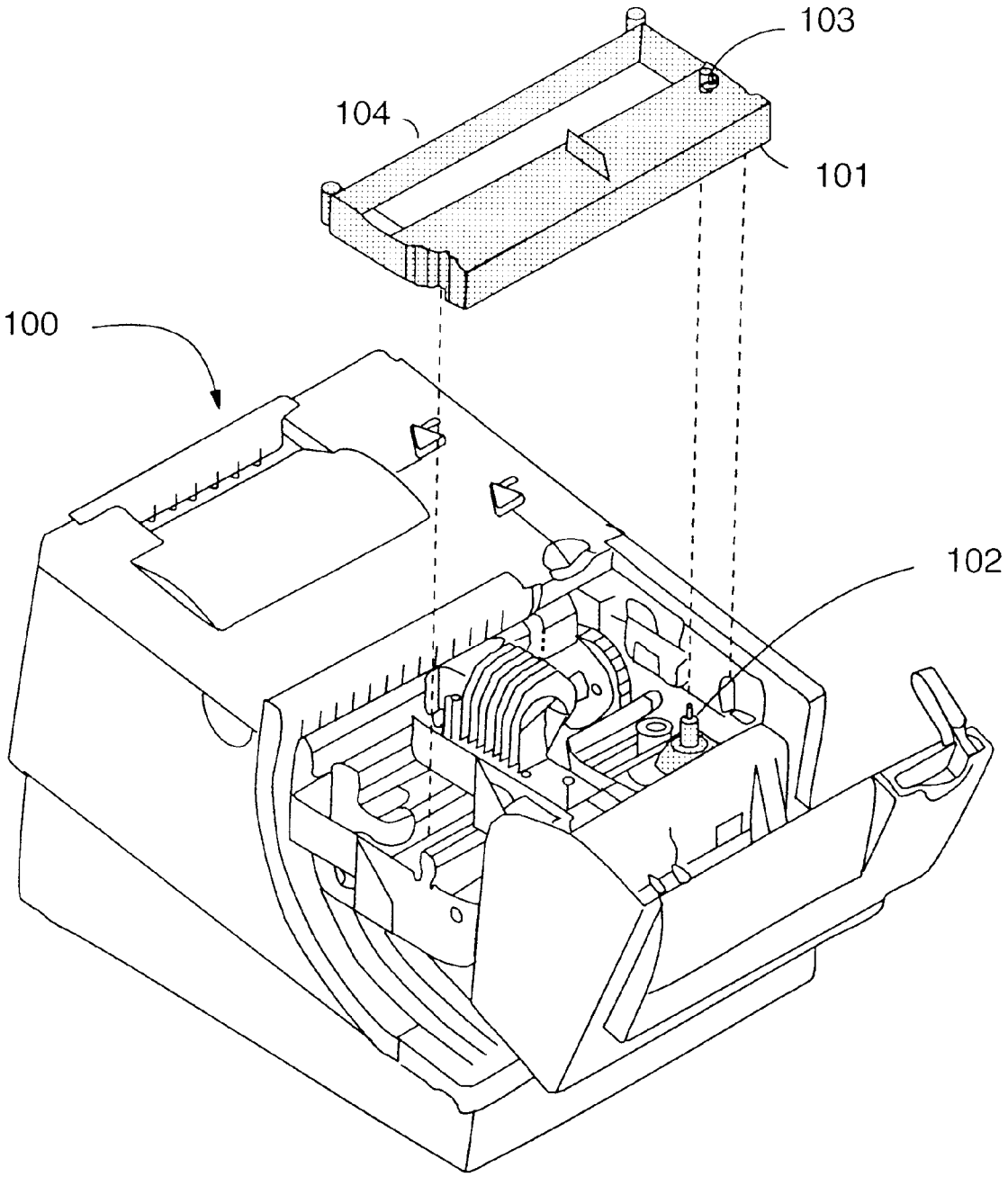
FIG. 1 illustrates a printer incorporating a ribbon drive in accordance with an embodiment of the present invention.
Figure 2:
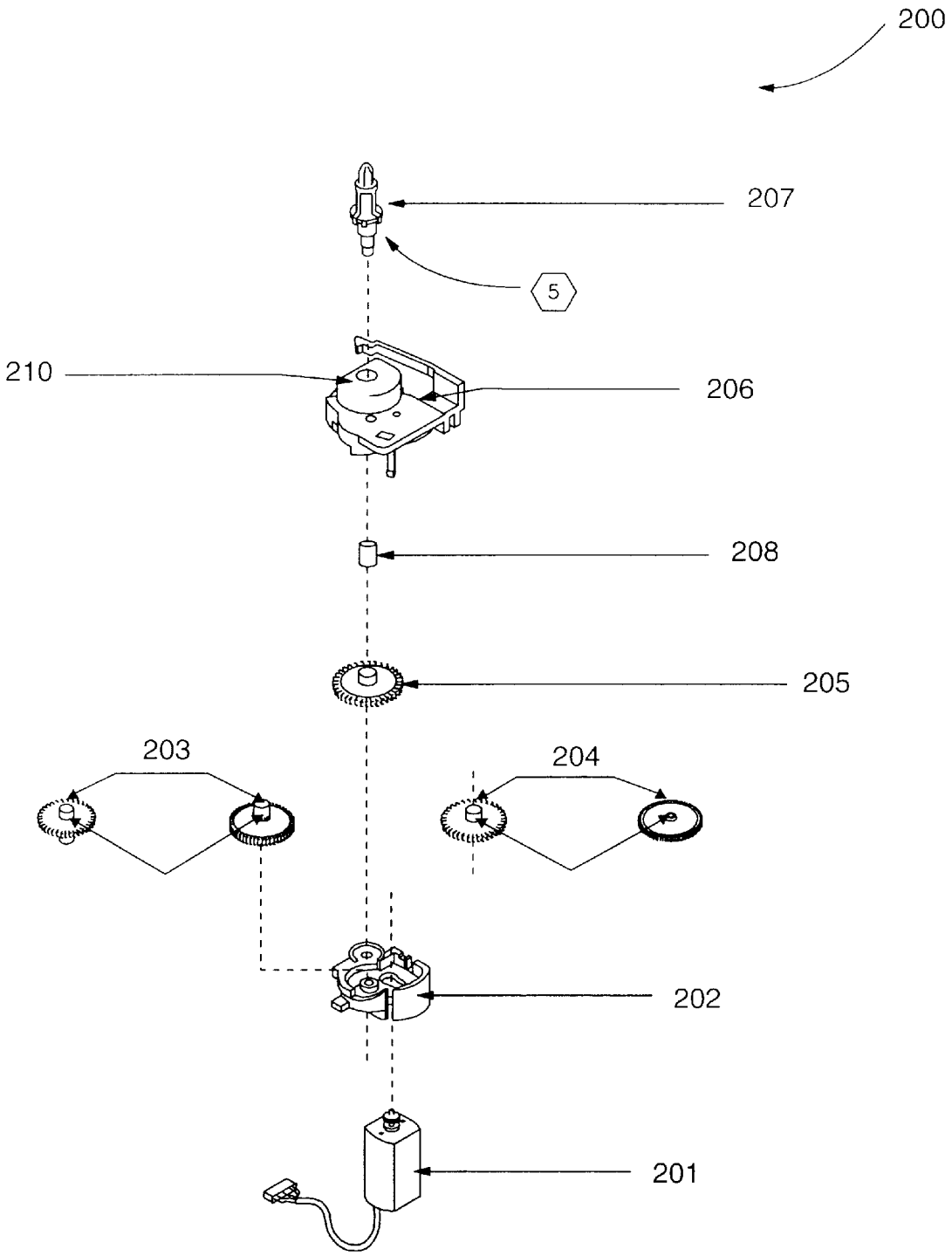
FIG. 2 illustrates a ribbon drive in accordance with the prior art.

In the following description, numerous specific details are set forth to provide a thorough understanding of the present invention. However, it will be obvious to those skilled in the art that the present invention may be practiced without such specific details. Refer now to the drawings wherein depicted elements are not necessarily shown to scale and wherein like or similar elements are designated by the same reference numeral for the several views.

Figure 3:
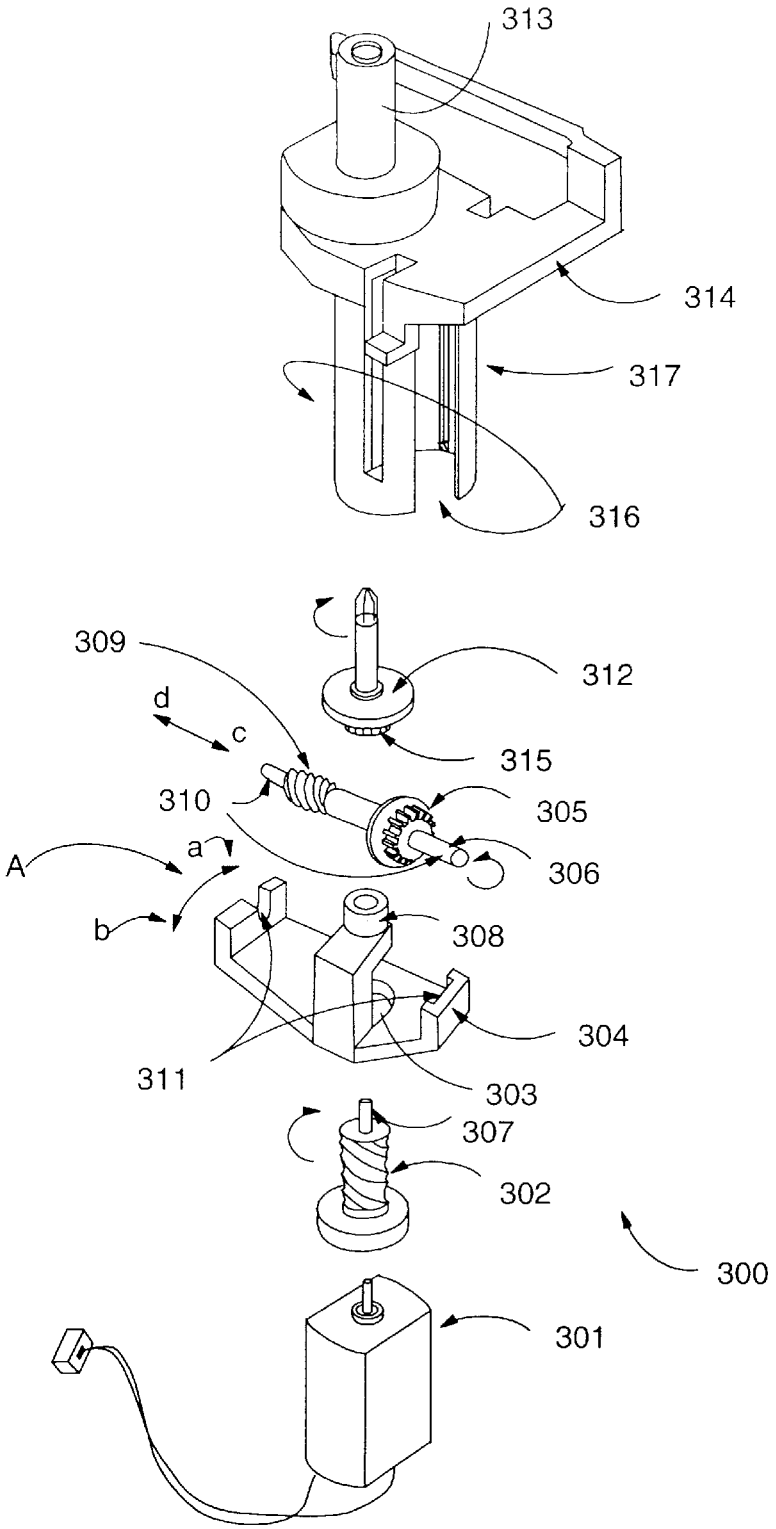
FIG. 3 illustrates an exploded view of a mechanical transmission in accordance with an embodiment of the present invention.

Refer now to FIG. 3 in which is depicted an exploded view of an improved mechanical transmission 300 in accordance with an embodiment of the present invention. Mechanical transmission 300 may be a ribbon drive, such as ribbon drive 102. Drive means 301 rotates worm gear 302. Worm gear 302 passes through an opening 303 in worm gear frame 304 to engage pinion gear 305 on compound worm gear 306. Journal 307 on worm gear 302 is supported in bearing 308 on worm gear frame 304. Worm gear frame 304 is pivotally suspended about worm gear 302 and is free to pivot through angle "A" in the "a-b" direction. Compound worm gear 306 also includes worm 309 at an end opposite that of pinion gear 305. Journals 310 of compound worm gear 306 are supported in frame bearings 311 in worm gear frame 304.

Figure 4:
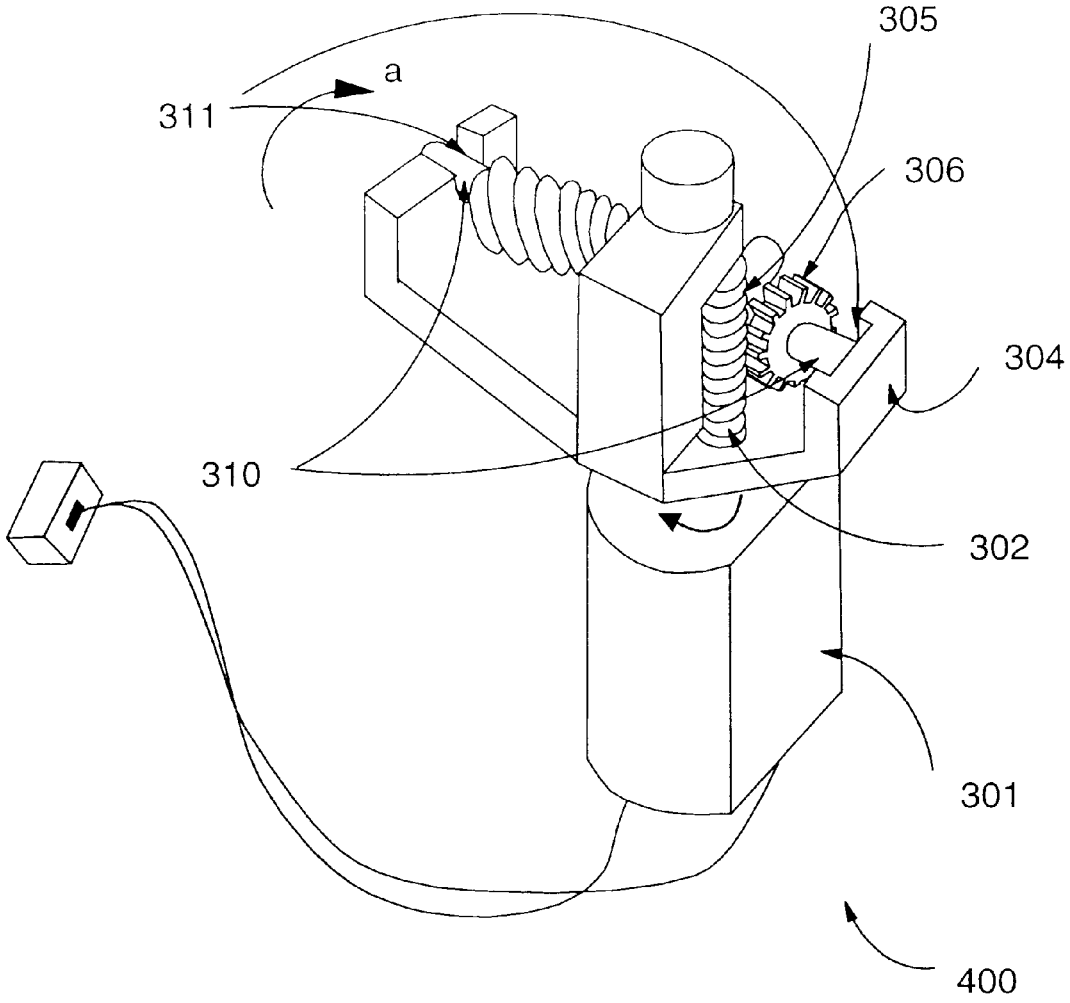
FIG. 4 illustrates a partial assembly of a manual transmission in accordance with an embodiment of the present invention.

The relationship between worm gear 302, worm gear frame 304 and compound worm gear 306 can be appreciated by now referring to FIG. 4. Depicted therein is a partial assembly 400 of an improved ribbon drive 300. Worm gear 302 engages pinion gear 305 on compound worm gear 306 which is held in worm gear frame 304. Compound worm gear 306 is rotatably supported by journals 310 in frame bearings 311.

When worm gear 302 is driven by drive means 301, motions of compound worm gear 306 and worm gear frame 304 are produced. Driving worm gear 302 in the direction illustrated, clockwise when viewed from above in FIG. 4, causes a rotation of compound worm gear 306 in frame bearings 311. The force acting on pinion gear 305 giving rise to this rotation acts on a thread of worm gear 302. This force has both a vertical and horizontal component. The vertical component tends to rotate pinion gear 305 and is resisted by journals 310 against frame bearings 311. The horizontal component is resisted by worm gear frame 304, and since the thread of worm gear 302 is displaced a distance from a center line through worm gear 302, it produces a moment about that center line. This moment tends to cause compound worm gear 306, and thereby worm gear frame 304, to pivot about worm gear 302 in direction "a" as shown. This motion is restrained by pinion 312 in FIG. 3.

Figure 5:
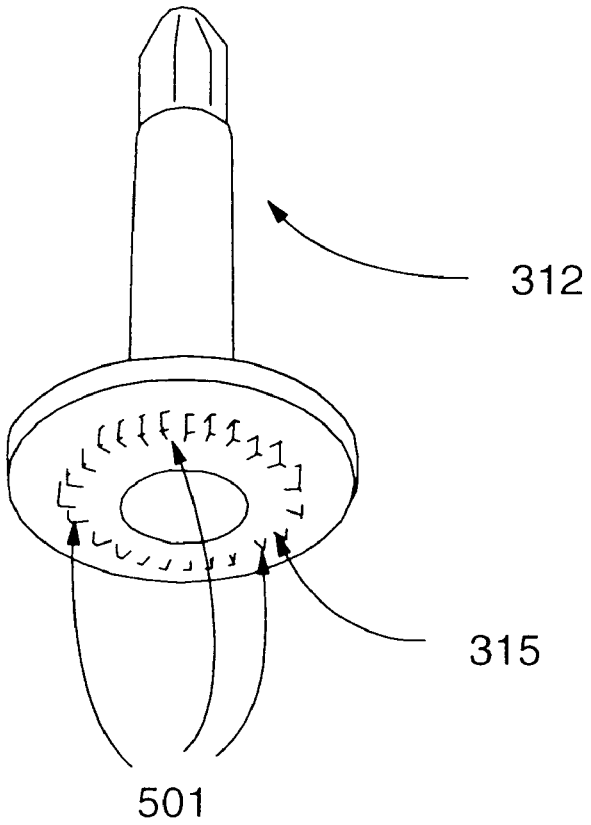
FIG. 5 illustrates a bottom view of a pinion in accordance with an embodiment of the present invention.
Figure 6:
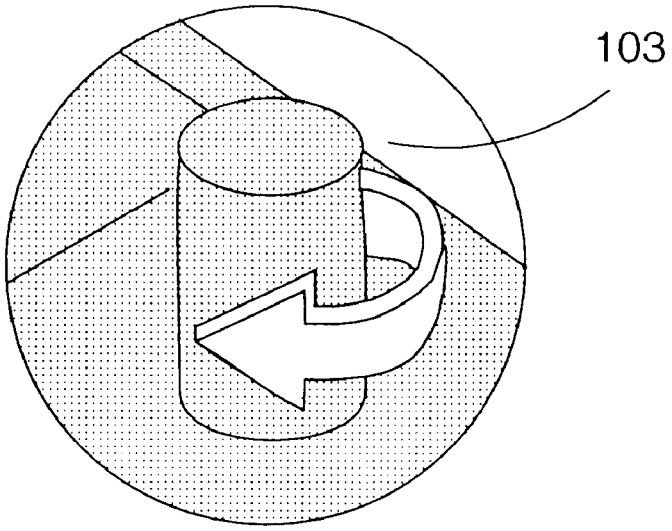
FIG. 6 illustrates a view of a ribbon-tightening knob of FIG. 1 in accordance with an embodiment of the present invention.

As shown in FIG. 3, pinion 312 extends through guide 313 on housing 314 and engages a spool (not shown) in ribbon cartridge 101. Partial assembly 400 is inserted in housing 314 whereby worm 309 on compound worm gear 306 engages pinion gear 315 on pinion 312. A bottom view of pinion 312 is shown in FIG. 5, whereby pinion gear 315 may be better appreciated. As worm gear frame 304 tends to pivot in the direction "a" in FIG. 3 under the action of the moment about the center line of worm gear 302, as described hereinabove, it is forced into engagement with pinion gear 315 on pinion 312. Compound worm gear 306 simultaneously is rotating in frame bearings 311.

The rotation of compound worm gear 306 and thence worm 309 causes a rotation of pinion gear 315 and pinion 312 of which it is a part. The rotation is a consequence of the force acting on the teeth 501 of pinion gear 315 by the thread forming worm 309. The teeth 501 react back on worm 309. There is a component of the reaction force along a center line of compound worm gear 306. This force is in the direction "c" shown in FIG. 3 when pinion 312 is driven in the direction of rotation, as shown in FIG. 3. This force acts on the thread forming worm 309, and because this thread is displaced laterally from the center line of worm gear 302, the reaction force produces a moment about the center line. This moment tends to cause compound worm gear 306, and thereby worm gear frame 304, to pivot in the direction "a" about worm gear 302. Thus, the reaction of teeth 501 on worm 309 produces a moment about worm gear 302 that compliments the moment due to the force of worm gear 302 on pinion gear 305, as previously described.

When the drive means 301 is not energized, the printer ribbon 104 can be manually tightened by rotation of knob 103. Pinion 312 is rotated by knob 103, with which it is engaged through a spool (not shown) in ribbon cartridge 101, in the driven direction as shown on FIG. 3. Now teeth 501 act on the thread forming worm 309, tending to cause compound worm gear 306 to rotate. More importantly, this force has a component along the center line of compound worm gear 306 in the direction "d" shown in FIG. 3. This force produces a moment about worm gear 302 as previously described, but now the moment causes compound worm gear 306 and thereby worm gear frame 304 to pivot in direction "b" in FIG. 3. Furthermore, unlike the driven case, there is nothing corresponding to pinion 312 to oppose this tendency, so worm gear frame 304 is free to pivot until worm 309 disengages from pinion gear 315. In an embodiment of the present invention in which frame 317 of housing 314 encloses partial assembly 400, openings 316 in frame 317 are such that worm gear frame 306 is free to pivot sufficiently to allow this disengagement to occur.

An embodiment of the present invention may have an electric motor as a drive means. In an alternative embodiment, an electric motor drive means may be a direct current (D. C.) electric motor.

The rate of rotation of pinion 312 and thereby the printer ribbon 104, is reduced from the rate of rotation of the drive means by the action of worm 309 and pinion gear 315 along with worm gear 302 and pinion gear 305. The reduction ratio is determined by the number of teeth on pinion gear 305 and pinion gear 315, as well as the number of threads forming each of worm 309 and worm gear 302. Embodiments of the present invention may include multithreaded worms in either worm 309, worm gear 302, or both. In such embodiments, the reduction ratio value is smaller than the reduction ratio value in an embodiment in which worm 309 and worm gear 302 are singly threaded, provided the numbers of teeth on pinion gear 305 and pinion gear 315 are otherwise unchanged. It would be understood by an artisan of ordinary skill that embodiments employing singly threaded worms, multithreaded worms or a combination thereof are within the scope of the claimed invention, as are pinion gears having any predetermined numbers of teeth.

It would be further understood by one of ordinary skill in the art that an alternative embodiment of the mechanical transmission of the present invention may be used when it is necessary to drive a load from two motive devices.

Although the present invention and its advantages have been described in detail, it should be understood that various changes, substitutions and alterations can be made herein without departing from the spirit and scope of the invention as defined by the appended claims.

What is claimed is:

1. A printer comprising:

a printer head;

a ribbon cartridge including a ribbon and a housing to position the ribbon adjacent to the printer head such that printing on a print medium can occur;

a ribbon drive motor including a drive shaft;

a ribbon drive coupled to the ribbon drive motor and coupled to the ribbon cartridge such that the ribbon is advanced relative to the print head in response to a movement of the drive shaft, the ribbon drive including means for disengaging said ribbon drive motor from said ribbon cartridge;

a means operable for permitting a manual advancing of said ribbon relative to said print head, and wherein said means for disengaging said ribbon drive motor from said printer cartridge further comprises:

a first gear having a first axis of rotation; and a second gear having a second axis of rotation perpendicular to the first axis of rotation engaging said first gear, wherein said first gear is operable for disengaging from said second gear when said ribbon is manually advanced.

2. The printer of claim 1 wherein said first gear is operable for pivoting about an axis, said pivoting effecting said disengagement of said first gear from said second gear.

3. The printer of claim 2 wherein said pivoting of said first gear comprises:

a pivoting in a first direction; and a pivoting in a second direction.

4. The printer of claim 3 wherein said pivoting in a second direction operates to disengage said first gear and said second gear.

5. The printer of claim 4 wherein said pivoting in a first direction operates to engage said first gear and said second gear.

6. The printer of claim 5, further comprising a ribbon tightening means, and wherein said pivoting in a first direction is in response to torques induced by said drive means, and said pivoting in a second direction is in response to torques induced by said ribbon tightening means.

7. A printer comprising:

a printer head:

a ribbon cartridge including a ribbon and a housing to position the ribbon adjacent to the printer head such that printing on a print medium can occur;

a ribbon drive motor including a drive shaft;

a ribbon drive coupled to the ribbon drive motor and coupled to the ribbon cartridge such that the ribbon is advanced relative to the print head in response to a movement of the drive shaft, the ribbon drive including means for disengaging said ribbon drive motor from said ribbon cartridge;

a means operable for permitting a manual advancing of said ribbon relative to said print head;

wherein said means for disengaging said ribbon drive motor from said printer cartridge further comprises:

a first gear having a first axis of rotation; and a second gear having a second axis of rotation perpendicular to the first axis of rotation engaging said first gear, wherein said first gear is operable for disengaging from said second gear when said ribbon is manually advanced; and wherein said ribbon drive further comprises:

a third gear, said third gear adapted for operating with said ribbon drive motor; and a fourth gear engaging with said third gear, wherein said fourth gear is adapted for pivoting about said third gear, said third gear forming an axis thereby, said fourth gear being attached to said first gear and pivoting therewith.

8. The printer of claim 7, further comprising a gear frame, and wherein said fourth gear and said first gear further include a common shaft therebetween, said first gear, said fourth gear and said common shaft being supported in said gear frame which is coupled to said third gear, wherein said gear frame is adapted for pivoting about said third gear.

* * * * *